US006733074B2

(12) United States Patent
Groth

(10) Patent No.: US 6,733,074 B2
(45) Date of Patent: May 11, 2004

(54) SUPPORT ASSEMBLY FOR USE WITH A WHEELCHAIR

(75) Inventor: Michael C. Groth, Brookfield, WI (US)

(73) Assignee: Marken International, Inc., Bozerman, MT (US)

( * ) Notice: Subject to any disclaimer, the term of this patent is extended or adjusted under 35 U.S.C. 154(b) by 0 days.

(21) Appl. No.: 10/184,252

(22) Filed: Jun. 28, 2002

(65) Prior Publication Data

US 2004/0000804 A1 Jan. 1, 2004

(51) Int. Cl.[7] ..... A47C 7/46

(52) U.S. Cl. ..... 297/284.4; 297/440.2; 297/452.31

(58) Field of Search ..... 297/284.1, 284.4, 297/230.1, 230.11, 230.14, 440.2, 452.31, 452.55

(56) References Cited

U.S. PATENT DOCUMENTS 3,813,148 A * 5/1974 Kraus ..... 297/284.4
4,883,320 A * 11/1989 Izumida et al. ..... 297/452.56
5,127,709 A * 7/1992 Rubinstein et al. ..... 297/440.2
5,148,563 A * 9/1992 Klearman et al. ..... 5/652
5,556,168 A * 9/1996 Dinsmoor et al. ..... 297/440.2
5,593,211 A * 1/1997 Jay et al. ..... 297/440.2
6,186,594 B1 2/2001 Valiquette et al.
6,257,664 B1 * 7/2001 Chew et al. ..... 297/284.9

* cited by examiner

*Primary Examiner*—Peter R. Brown
(74) *Attorney, Agent, or Firm*—Joseph S. Heino

(57) ABSTRACT

A wheelchair backrest assembly is attachable to a wheelchair to replace the standard web or sling-type back. The backrest assembly is comprised of a rectangular frame having a central opening defined within it, the rectangular frame has sides curved forwardly to accommodate users of various sizes and shapes. A plurality of support members are attached to the frame and mountable to the upright cane portions of the wheelchair. The front portion of the rectangular frame, or that portion facing the wheelchair user, is covered by a cushioned pad, the back of which has a plurality of pockets designed to accommodate formable stays. The shape of each stay may be molded by hand and should be of a material resilient enough to withstand frequent reforming and yet should be strong enough such that when a user reclines against the backrest, the stays remain in place.

27 Claims, 4 Drawing Sheets

SUPPORT ASSEMBLY FOR USE WITH A WHEELCHAIR

FIELD OF THE INVENTION

This invention relates generally to wheelchairs and to accessory items and assemblies for use with wheelchairs. More particularly, it relates to a flexible backrest support assembly that can be easily adjusted to fit the contours of a user's back.

BACKGROUND OF THE INVENTION

Conventional wheelchairs are normally equipped with a "sling-type" backrest. That is, the backrest consists of a web of material that extends between two generally upright support members located to the rear of the wheelchair and adjacent the user's back. Wheelchairs have been constructed using such webs or slings for many years because such a configuration permits easy folding and storage of the wheelchair. As originally intended, such wheelchairs were used, and are still used, for short terms and for very transient situations where a patient spends only that amount of time in the chair as it takes to go from one point to another within a healthcare facility. Such chairs were not really designed with long term usage in mind. However, prolonged use of a sling-type wheelchair backrest may negatively affect the user's posture, comfort and overall health. In fact, long-term wheelchair users frequently develop a condition known as kyphosis, a front to back curvature of the spine. In the experience of this inventor, conventional web or sling-type backrests fail to provide any lateral support whatsoever. Over time, this lack of support can lead to a condition known as scoliosis, or sideways curvature of the spine. In the case of the institutionalized patient or the wheelchair user who must spend the greater part of his or her waking hours in such a chair, prior web or sling-type backrests are completely unacceptable.

Considering the above enumerated problems, there has long been a need for improvement in the art of producing wheelchairs and wheelchair back supports in particular. Unfortunately, inventors in this area face numerous problems. As alluded to, wheelchair users require the low weight, flexibility, foldability and simplicity of prior designs but also recognize that persons who need the assistance of a wheelchair often have other special needs not met by prior designs.

In response to these conflicting needs, adjustable tension seat backs have been introduced. These innovations attempted to preserve the low weight, flexibility and foldable characteristics of earlier chairs while accommodating users with the aforementioned spine and back problems. Unfortunately, these back supports still frequently fail to provide adjustments to accommodate the wide variety of users that use such chairs.

Another problem that wheelchair designers frequently face is that the end user is often not a specific individual with specific problems, but an assisted care facility with numerous individuals having a wide variety of problems. Therefore, a wheelchair that can be easily adjusted and readjusted for numerous users is required.

SUMMARY OF THE INVENTION

It is, therefore a principal object of the present invention to provide a new, useful, and uncomplicated assembly for providing improved back support for a wheelchair user. It is a further object of this invention to provide such an assembly having means for lateral back support for the wheelchair user. It is also an object of this invention to provide such an assembly that requires only a minimal number of elements and a minimal amount of steps to utilize. It is yet another object of this invention to provide such an assembly that can readily be used by a wide variety of wheelchair occupants having upper body weakness or spinal deformities of every nature. It is still another object of this invention to provide such an assembly that is readily and quickly adjustable so as to accommodate the many shapes and sizes of persons needing to use the wheelchair that is equipped with the assembly of the present invention. It is still another object of this invention to provide such an assembly that may be variably used to apply support to the wheelchair occupant's back and rib cage area.

In addition to the foregoing stated objectives, it is also an object of the present invention to provide a backrest support that is easily removable. It is yet another object of the present invention to employ a general wheelchair configuration so that present sling-back type wheelchairs can be retrofitted with this invention. It is yet another object of the present invention to provide a wheelchair support assembly that does not require tools to install and is easily moldable. It is yet another object of this invention to employ a flame retardant material in the construction of the backrest assembly.

The present invention has obtained these objects. It provides for a wheelchair backrest assembly that is attachable to an ordinary wheelchair to replace the standard web or sling-type back. The backrest assembly is comprised of a rectangular frame having a central opening defined within it, said rectangular frame having sides curved forwardly to accommodate users of various sizes and shapes. The assembly of the present invention also includes a plurality of support members attached to said frame and mountable to the upright cane portions of the wheelchair. The front portion of the rectangular frame, or that portion facing the wheelchair user, is covered by a cushioned pad and the back has a plurality of pockets designed to accommodate a plurality of formable stays, said formable stays being supported solely by the top and bottom of the rectangular frame. The stays may also be made of a preformed material that is designed to accommodate a specific individual. The stays may either be removed from the pockets and formed or left within the pockets and formed or molded by hand. No tools are required. The formable stays should be of a material resilient enough to withstand frequent reforming and yet should be strong enough such that when a user reclines against the backrest, the stays remain in place. The foregoing and other features of the assembly of the present invention will be apparent from the detailed description that follows.

DETAILED DESCRIPTION

The following detailed description is intended to describe the preferred embodiments that are depicted in the figures. It is to be understood that changes could be made to that which is specifically described and shown that would still fall within the scope of the present invention.

Figure 1:
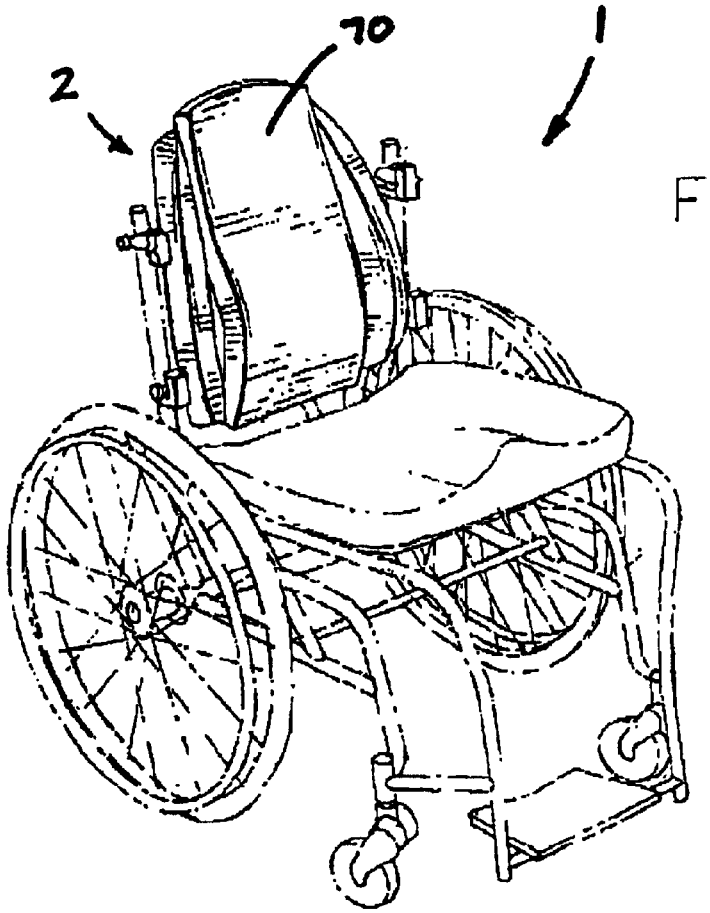
FIG. 1 is a front, top and left side perspective view of the backrest assembly of the present invention as it is installed on a conventional wheelchair.

Referring now to the drawings in detail, wherein like numbered elements refer to like elements throughout, FIG. 1 illustrates a preferred embodiment of backrest assembly of the present invention as it is installed on a wheelchair, generally identified 1. The backrest assembly, generally identified 2, is intended and designed by this inventor for use with all standard wheelchairs 1.

Figure 7:
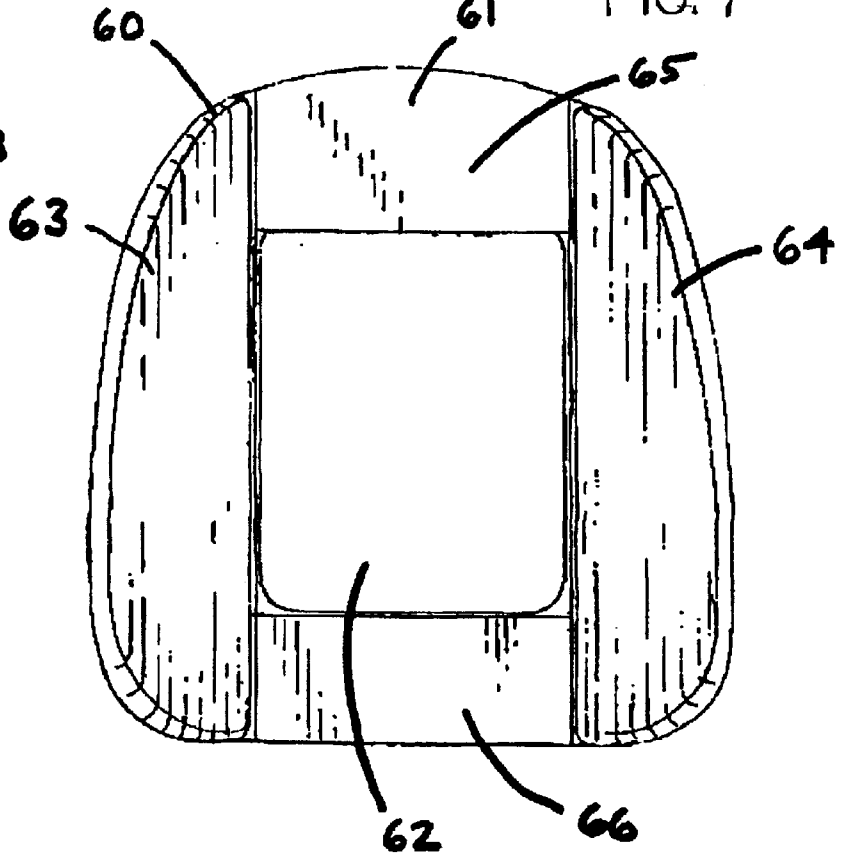
FIG. 7 is a front elevational view of the outer shell portion of the backrest assembly.
Figure 6:
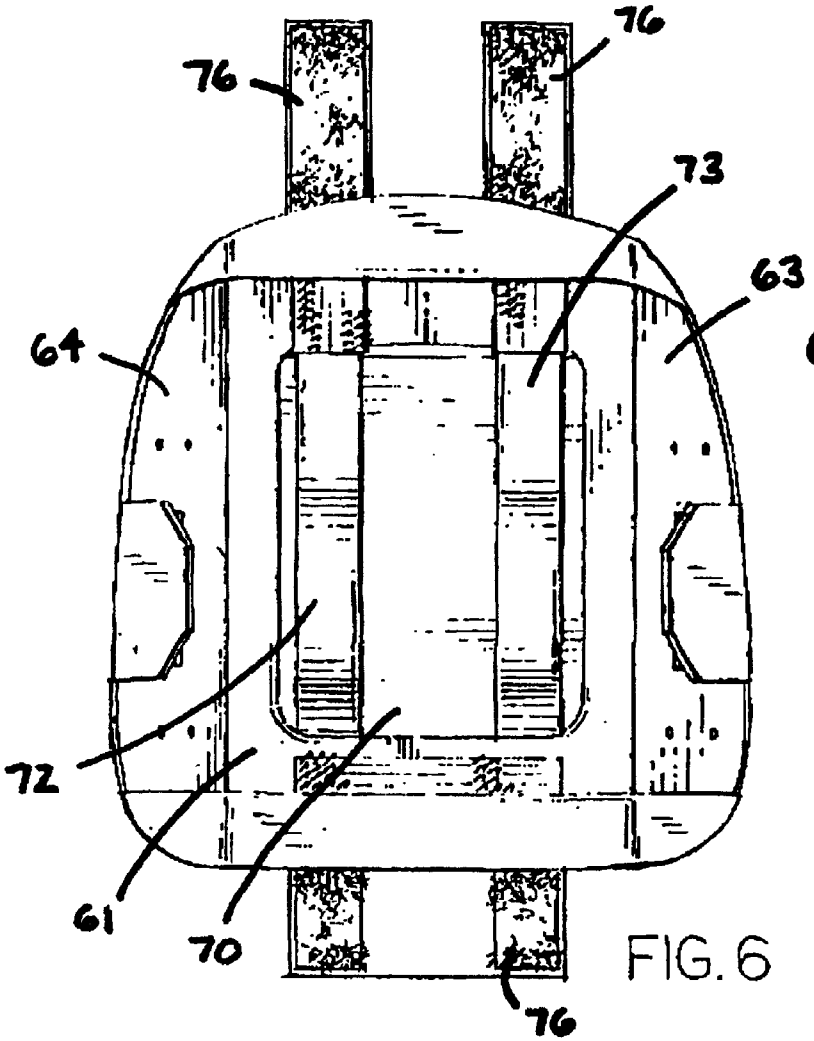
FIG. 6 is a rear elevational view of the backrest assembly and showing the central support member.

The backrest assembly 2 employs a thermoplastic material, such material having a high tensile and impact strength, for the outer shell portion 60 of the assembly 2. See also FIG. 7. Thermoplastic material is preferred for its light weight and relatively easy formability. It also provides the advantages of good stiffness and strength as well as flame retarding capability. The backrest assembly 2 may also employ a Viscoback™ cushioning system. The Viscoback™ cushioning system combines a high loft cushioning system with memory foam. The cushioning system provides for accommodation of patients with sensitive bony prominences and patients who develop areas of high pressure when they use the wheelchair 1.

Figure 5:
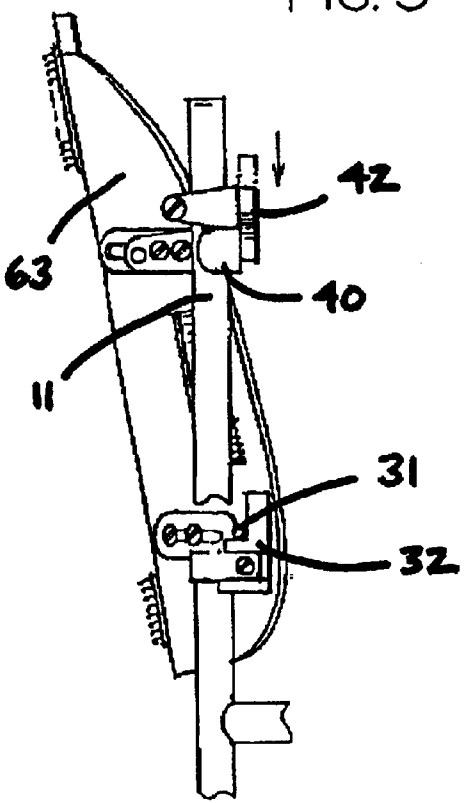
FIG. 5 is a left side elevational view of the backrest assembly.
Figure 4:
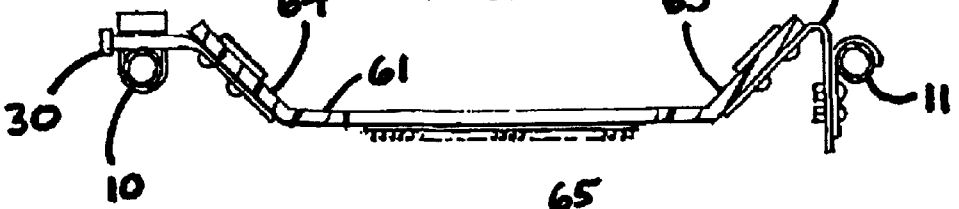
FIG. 4 is a top plan and cross-sectioned view of the backrest assembly taken along line 4—4 of FIG. 3 and showing the means of attachment at the top of the backrest and the means of attachment at the bottom of the backrest.
Figure 3:
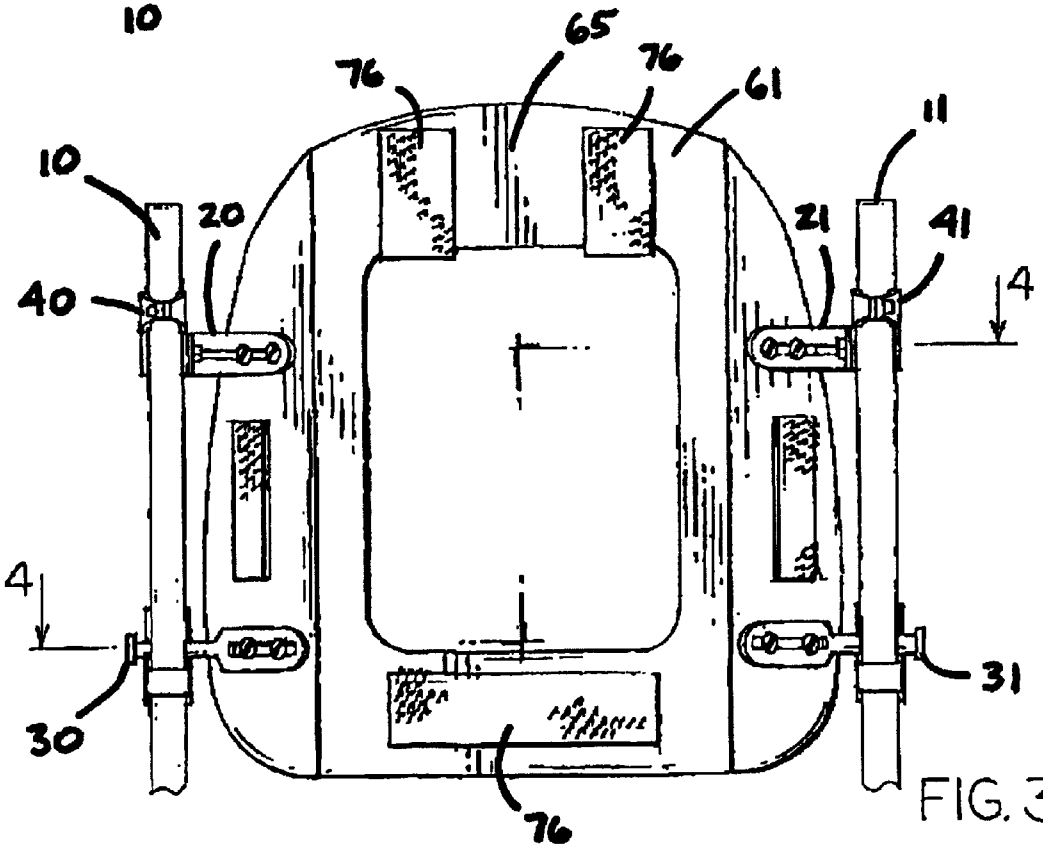
FIG. 3 is a further enlarged rear elevational view of the backrest assembly without the central support member in place.

The outer shell portion 60 of the assembly 2 is generally in the shape of a generally planar and somewhat rectangular shell exterior 61 and an open interior 62. The open interior 62 is also generally rectangular and generally follows the contours of the exterior 61 of the shell 60. It is to be understood, however, that the precise shape of the shell opening 62 is not a limitation of the present invention. The backrest shell 60 may also include a pair of lateral wings 63, 64. The lateral wings 63, 64 each extend at an angle forwardly of the plane of the backrest shell central exterior 61. See FIG. 4. The lateral wings, 63, 64 can be of any shape or size but in the preferred embodiment they are approximately 3 inches wide at their widest. The lateral wings 63, 64 in the preferred embodiment then arcuately taper in towards the backrest shell central exterior 61 both upwardly and downwardly. See FIG. 5.

Figure 8:
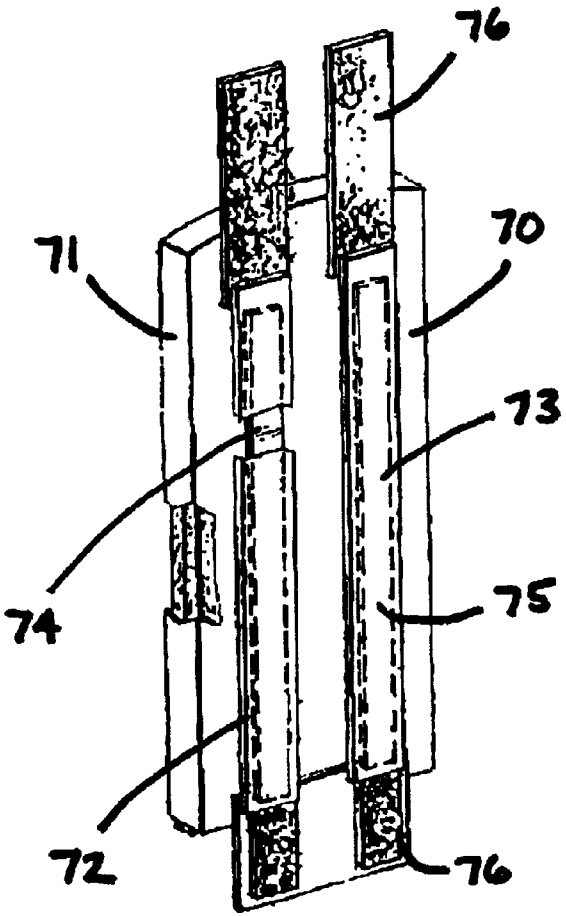
FIG. 8 is a rear, top and right side perspective view of the central support member of the backrest assembly and showing the pockets and stays defined within it.

In a preferred embodiment of the invention, the backrest hard shell 60 provides support for an infinitely adjustable back support central insert member 70. This infinitely adjustable back support insert 70 is comprised of a flexible shell 71, a pair of stays 74, 75, and may include a cushioning system 78 as previously alluded to. The flexible shell 71 is configured to fit over the top 65 and the bottom 66 of the wheelchair backrest shell 60. It is important that the entirety of the backrest hard shell 60 is covered by the flexible shell 70 so that the patient is not exposed to any of the hard backrest shell 60. The flexible shell 71 has a pair of parallel pockets 72, 73 that extend from the top of the backrest shell 65 to the bottom of the backrest shell 66. In the preferred embodiment, the flexible shell 71 is supported by a pair of aluminum stays 74, 75 that are inserted within the pockets 72, 73 of the flexible shell 71. See FIG. 8. The aluminum stays 74, 75 should be long enough such that they fully extend between the top 65 and the bottom 66 of the wheelchair backrest shell 60. It is also to be understood that the stays 74, 75 need not be constructed of aluminum. The stays 74, 75 can be constructed of any suitable material that is rigid, yet formable for the stated purpose.

Figure 10:
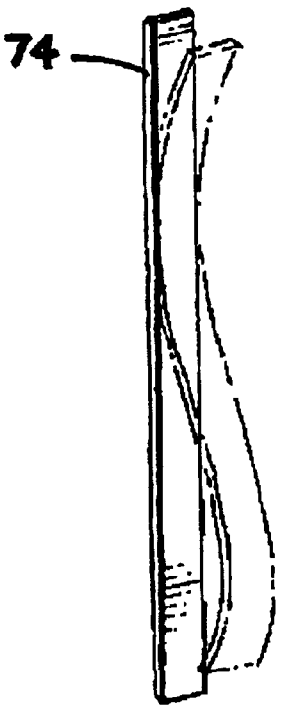
FIG. 10 is a front, top and left side perspective view of the one of the stays used within the central support member of the backrest assembly.
Figure 9:
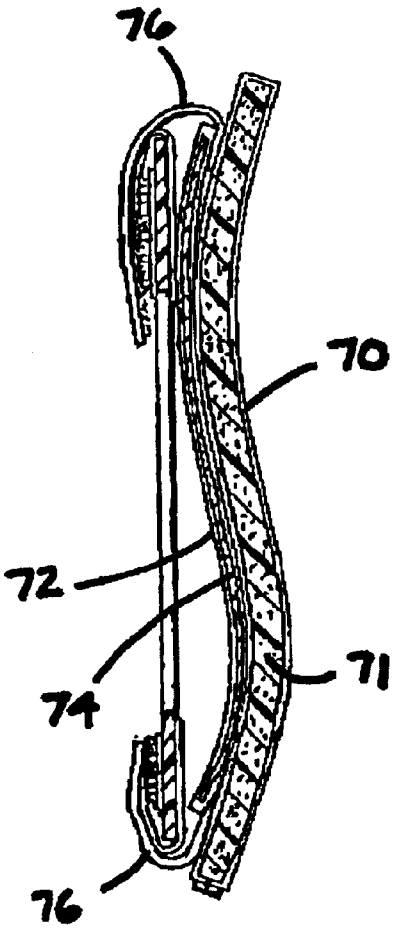
FIG. 9 is a left side elevational and cross-sectioned view of the backrest assembly.

In a preferred embodiment, the aluminum stays 74, 75 are fabricated to be 1½ inch wide and about ⅛ inch thick. See FIG. 10. The stays 74, 75 are designed to be flexible enough to be formable by hand but stiff enough such that they stay in position when the wheelchair occupant leans against them. See FIG. 9. The stays 74, 75, in turn, support the cushioning system 78. Generally, the stays, 74, 75 run through the pockets 72, 73 and are configured to be parallel to the user's back. The stays 74, 75 can then be formed by the user or healthcare provider to accommodate each individual patient's back. For example, in the case of a person having kyphosis, the front to back curvature of the spine, the stays 74, 75 can be formed to match the curvature of the patient's spine or even used as a corrective orthotic for the patient's back. If kyphosis were the patient's only back problem, the stays 74, 75 would most likely be formed using the same radius of curvature. The stays 74, 75 can also be used to treat or to comfort patients with conditions such as scoliosis, the side to side curvature of the spine. In the case of scoliotic patients, the stays 74, 75 are normally individually formed to match the contours of each side of the patient's back relative to the spine.

In the experience of this inventor, patients who spend a significant amount of time in a wheelchair may either have or develop scoliosis, kyphosis, or both. It is therefore important to provide an adjustable backrest assembly 2 that allows for different patient needs and conditions, while providing a corrective feature. The inventor is also aware that patients needing wheelchairs 1 come in to different shapes and sizes and envisions a tall version of the above discussed embodiment as well as a bariatric version. The bariatric version of the wheelchair assembly 2 will likely provide more support, perhaps using a stiffer material for the stays 74, 75. The bariatric version may also provide a flexible backrest having either wider stays 74, 75 or even more stays 74, 75 to accommodate the physical needs of the obese patient.

Figure 2:
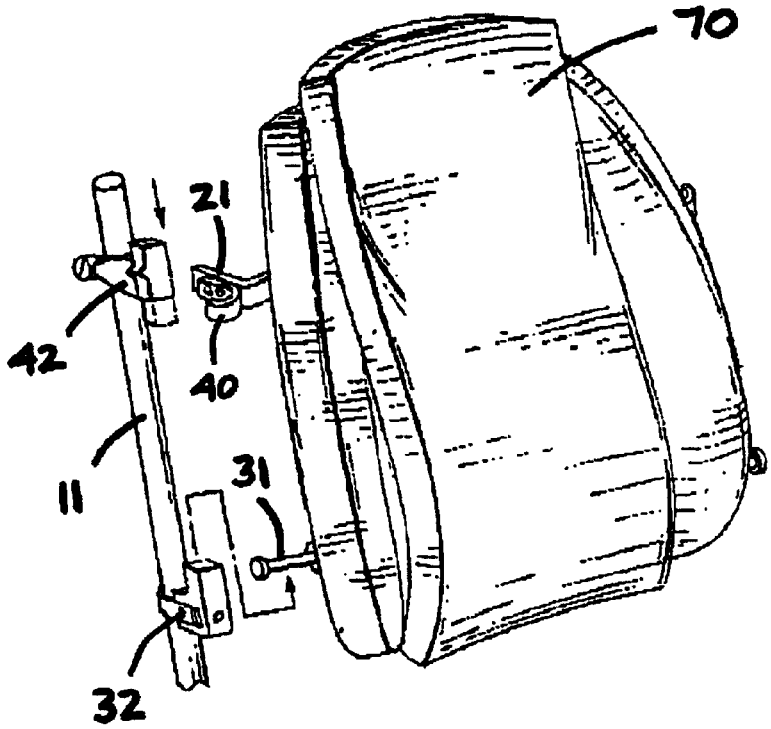
FIG. 2 is an enlarged front, top and left side perspective view of the backrest assembly shown in FIG. 1.

The flexible backrest shell 70 can be held on the rigid backrest shell 60 using any number of design contingencies, but low cost and simplicity are high priorities in this field. In the preferred embodiment shown in FIG. 2, hook and loop type fastening straps, generally identified 76, are used to hold the flexible shell 70 on the backrest 60. The use of such hook and loop type fastening straps 76 allows the user to remove the flexible shell 70 quickly and easily for cleaning and reconfiguration.

In the preferred embodiment, the rigid shell 60 of the backrest assembly 2 is held in place at the top using a combination of angle brackets 20, 21 and chair hooks 40, 41, and at the bottom using a pair pivot arms 30, 31. The angle brackets 20, 21 are attached to the backrest shell 60. It should be noted that the angle brackets 20, 21 offer a continuous aperture for mounting the angle brackets 20, 21 to the backrest shell 60. The chair hooks, 40, 41 are attached to the upright wheelchair canes 10, 11. There are several possible types of chair hooks but two will be discussed here. The regular chair hook 70, 71 provides three mounting apertures. Each mounting position corresponds to approximately 5° of recline relative to the vertical. The regular chair hook 40, 41 provides for approximately 10° of recline. A long chair hook (not shown) can provide up to 20° of recline. To attach the assembly 2 to the wheelchair 1, the angle bracket 20, 21 is simply attached to the chair hook 40, 41 using a fastener of most any type. It should be noted that one should consider the amount of recline afforded the patient at this stage. The backrest shell 60 is also attached to the wheelchair canes 10, 11 further down on the canes 10, 11 using pivot arms 30, 31. The pivot arms 30, 31, are designed to support the backrest shell 60 regardless of the angle of recline of the backrest shell 60. The pivot arms 30, 31 also offer a continuous aperture such that they can be mounted on the backrest shell 60 anywhere along their length. The importance in having the continuous apertures for mounting the backrest shell 60 using the angle brackets and pivot arms is that wheelchair producers have built many different sizes of wheelchairs over the years, but most of them can be accommodated by permitting the installer to adjust the width of the aforementioned attachments.

Yet another embodiment of the device of the present invention incorporates a device comprised of a lower clip 32 and an upper locking clip 42 attached to the wheelchair cane 10. See FIGS. 2 and 5. The user of the wheechair 1 first pulls the lower clip 32 over the pivot arm 31. The user then positions the upper locking clip 42 on the chair hook 40. The upper locking clip 42 has a locking slide mechanism that snaps downwardly onto the chair hook 40 when urged downwardly by the user. This system provides a quick release mechanism for the easy removal and reattachment of the wheelchair backrest assembly 2.

Yet another important feature of the present invention is the ease with which one can modify an existing wheelchair 1 having a web or sling-type support and customize that wheelchair 1 using the present invention. The present invention provides an assembly procedure involving only a few steps. First, the sling back (not shown) is removed from the wheelchair 1. Second, the upper chair hooks 40, 41 are mounted to the angle brackets 20, 21. Third, the lower pivot arms 30, 31 are mounted to the backrest shell 60 and pivot arms 30, 31 are mounted on the wheelchair canes 10, 11. Fifth, the backrest 60 is placed in the wheelchair 1. Lastly, the angle brackets 20, 21 are adjusted so that the chair hooks 40, 41 fit squarely over the wheelchair canes 10, 1 land the hard shell 60 is pressed firmly into the chair hooks 40, 41.

A device designed to improve the life of wheelchair users has been disclosed. The device of the present invention provides a wheelchair backrest that can be quickly and easily installed on an existing wheelchair. It also provides for an individually tailored orthotic backrest designed to fit the curvature of each patient's back. The present invention also provides for a wheelchair backrest that can recline up to 20° as such is desired or required. Lastly, the present invention provides for a wheelchair backrest that can be manually adjusted.

Further, it is not the inventor's intention to limit use of this invention solely to wheelchairs. The inventor of the product envisions a line of products employing the present invention to include office chairs and even chairs for the home.

Although I have very specifically described the preferred embodiments of the invention herein, it is to be understood that changes can be made to the improvements disclosed without departing from the scope of the invention. Therefore, it is to be understood that the scope of the invention is not to be overly limited by the specification and the drawings, but is to be determined by the broadest possible interpretation of the claims.

Based on the foregoing, I hereby claim as my invention:

1. A back support assembly for use with a wheelchair comprising a generally rectangular rigid backrest having a top portion and a bottom portion and a generally rectangular aperture therethrough, a pair of formable stays, each stay having a first end affixed to the top portion of the backrest and a second end affixed to the bottom of the backrest and a center portion over the aperture of the backrest, a cushioned exterior pad covering the front of the backrest and the stays, wherein, the contour of the cushioned exterior pad can be adjusted to the contour of the user's back by adjusting the shape of the stays.

2. The back support assembly of claim 1 wherein the backrest is fabricated from a thermoplastic material.

3. The back support assembly of claim 1 wherein the cushioned exterior pad employs high loft viscoelastic memory foam.

4. The back support assembly of claim 1 wherein the formable stays are aluminum.

5. The back support assembly of claim 1 wherein the slays can be repeatedly reformed to accommodate different users.

6. The back support assembly of claim 1 wherein the stays are permanently formed to fit a specific individual.

7. The back support assembly of claim 1 wherein forward angled lateral wings are integrally formed with and as part of the rigid backrest.

8. The back support assembly of claim 7 wherein each of the lateral wings is covered with a cushioned pad.

9. The back support assembly of claim 1 wherein the rigid backrest is removably attachable to the canes of a wheelchair and is angularly adjustable relative to the vertical.

10. A flexible back support assembly, said assembly being functionally adaptable to be used with a wheelchair, comprising a rigid backrest shell having a top portion and a bottom portion and having a generally rectangular aperture defined therewithin, a flexible cushioned shell covering the front of the backrest, said shell covering fitting snugly over the rigid backrest and having a cushioned exterior pad to one side and at least two vertically aligned longitudinal pockets to the opposite side, at least two stays, each stay being insertable within one of the pockets in the shell, said stays being formed to fit the shape of the user's back and being supported at a first end by the top portion of the backrest.

11. The flexible back support assembly of claim 10 wherein the backrest is fabricated from a thermoplastic material.

12. The flexible back support assembly of claim 10 wherein the cushioned pad uses high loft viscoelastic memory foam.

13. The flexible back support assembly of claim 10 wherein the stays are aluminum.

14. The flexible back support assembly of claim 10 wherein the stays can be reformed again and again to accommodate different users.

15. The flexible back support assembly of claim 10 wherein the stays are specifically designed for an individual and are not reformable.

16. The flexible back support assembly of claim 10 wherein forward angled lateral wings are attached to the rigid backrest shell.

17. The flexible back support assembly of claim 10 wherein the flexible shell is secured to the rigid backrest using hook and loop type fastening straps.

18. The flexible back support assembly of claim 10 wherein the angle of recline of the rigid backrest shell is variably adjustable.

19. A flexible back support for use with a wheelchair having a pair of upright canes comprising a generally rectangular rigid backrest having a top and a bottom and a generally rectangular aperture therethough, means for attaching said rigid backrest to the wheelchair canes, a flexible shell covering the front of the backrest and fitting snugly over the backrest and having a cushioned exterior pad on the front and a pair of vertical pockets in the back, and a pair of stays situated on either side of an imaginary centerline on the backrest, said stays being supported by the top and bottom of the backrest and each stay being insertable within one pocket in the shell, wherein the stays situated in the pockets of the flexible shall can be formed to the shape of the user's back.

20. The flexible back support of claim 19 wherein the means for attaching the rigid backrest comprises a pair of wheelchair hooks, attached to the canes of the wheelchair, a pair of angle brackets each having a first end attached to the rigid backrest and a second end attached to the wheelchair hooks, and a pair of pivot arms each having a first end attached to the rigid backrest and a second end permitting rotation of the rigid backrest attached to the wheelchair canes.

21. The flexible back support of claim 20 wherein the angle of recline is adjustable.

22. The flexible back support of claim 19 wherein the backrest is fabricated from thermoplastic material and the cushioned pad uses high loft viscoelastic memory foam.

23. The flexible beck support of claim 19 wherein the stays are aluminum.

24. The flexible back support of claim 19 wherein the stays can be reformed again and again to accommodate different users.

25. The flexible back support of claim 19 wherein the stays are specifically designed for an individual and are not reformable.

26. The flexible back support of claim 19 wherein forward angled lateral wings are attached to the rigid backrest.

27. The flexible back support of claim 19 wherein the flexible shall is secured to the rigid backrest using hook and loop type fastening straps.

* * * * *